US011033999B2

(12) United States Patent
Tsai

(10) Patent No.: US 11,033,999 B2
(45) Date of Patent: Jun. 15, 2021

(54) CLAMP OF BICYCLE WORKSTAND

(71) Applicant: JYIN SHENG CO., LTD., Huatan Township, Changhua County (TW)

(72) Inventor: Yu-Lung Tsai, Huatan Township, Changhua County (TW)

(73) Assignee: Jyin Sheng Co., Ltd., Huatan Township, Changhua County (TW)

( * ) Notice: Subject to any disclaimer, the term of this patent is extended or adjusted under 35 U.S.C. 154(b) by 235 days.

(21) Appl. No.: 16/253,745

(22) Filed: Jan. 22, 2019

(65) Prior Publication Data

US 2020/0230784 A1 Jul. 23, 2020

(51) Int. Cl.
*B25B 5/10* (2006.01)
*B25B 5/04* (2006.01)

(52) U.S. Cl.
CPC ..... *B25B 5/10* (2013.01); *B25B 5/04* (2013.01)

(58) Field of Classification Search
CPC ..... B25B 5/006; B25B 5/06; B25B 5/147; B25B 5/14; B25B 5/12; B25B 5/125; B25B 7/12; B25B 7/123; B25H 1/0007; B25H 1/0014
See application file for complete search history.

(56) References Cited

U.S. PATENT DOCUMENTS 8,613,433 B2 * 12/2013 Poole ..... B25B 5/12 269/228
2002/0117526 A1 * 8/2002 Anderson ..... B60R 9/06 224/536

FOREIGN PATENT DOCUMENTS

TW 572001 U 1/2004

* cited by examiner

*Primary Examiner* — Tyrone V Hall, Jr.
(74) *Attorney, Agent, or Firm* — Muncy, Geissler, Olds & Lowe, P.C.

(57) ABSTRACT

A clamp of a bicycle workstand includes a base, an elastic unit, an operating arm, a link unit, and a clamping unit. The base has an accommodating trough. The elastic unit has a shaft sleeved with a spring and a slide and disposed in the accommodating trough. The clamping unit has a fixed clamp body disposed on the base, and a movable clamp body pivotably connected with the base and the operating arm. The link unit has a first link and a second link pivotably connected with each other and pivotably connected with the operating arm and the slide respectively. The second link has a cam. Pulling the operating arm can drive the first and second links to swing. The cam is abutted on the shaft and presses it by rolling. The fixed clamp body and the movable clamp body can be coupled for stable clamping.

10 Claims, 8 Drawing Sheets

CLAMP OF BICYCLE WORKSTAND

BACKGROUND OF THE INVENTION

1. Field of the Invention

The present invention relates to bicycle supporting frames and more particularly, to a clamp of a bicycle workstand having relatively greater clamping effect.

2. Description of the Related Art

Taiwan Patent No. 572001 disclosed a structure of a bicycle workstand including a fixed clamp body, a movable clamp body, an adjusting base, and a controlling rod. The adjusting base is disposed on the fixed clamp body. The controlling rod is inserted through the adjusting base and protrudes out of the fixed clamp body and the movable clamp body. The section of the controlling rod protruding out of the movable clamp body is pivotably attached to a fastening rod. A fastening pressing sheet is sleeved onto the controlling rod and protrudes out of the fixed clamp body. The fastening pressing sheet can limit the axial displacement of the controlling rod, thereby adjusting the open and close condition of the movable clamp body relative to the fixed clamp body. Before the conventional bicycle workstand is used to fixedly clamp a bicycle top tube with relatively larger radius, the fastening pressing sheet should be firstly pulled to cause the controlling rod to displace to increase the distance between the movable clamp body and the fixed clamp body and accordingly decrease the pulling angle of the fastening pressing sheet and the fastening rod, thereby providing stable clamping effect. However, the operational action is a little complicated and inconvenient.

Besides, in the aforesaid conventional bicycle workstand, a rod is inserted in the fixed clamp body and a combination pipe and fastened by a pulling rod, enabling the fixed clamp body to swing to an appropriate angle relative to the combination pipe, so that the angle of the bicycle frame tube clamped on the bicycle workstand can be changed for benefiting the worker in the convenience of maintaining each portion and component of the bicycle. However, such effect can be achieved by other manners, unlimited to be achieved by the structure of the aforesaid patent.

SUMMARY OF THE INVENTION

It is a primary objective of the present invention to provide a clamp of a bicycle workstand, which is adapted to clamp bicycle frame tubes with different radius stably by equal clamping force and operated by convenient action.

It is another objective of the present invention to provide a clamp of a bicycle workstand, which enables the angle of the bicycle clamped on the bicycle workstand to be adjusted differently from the prior art, providing the user convenience in maintaining each portion and component of the bicycle.

To attain the above objective, the present invention provides a clamp of a bicycle workstand, which is adapted to be connected with a supporting frame for clamping a tube of a bicycle frame. The clamp includes a base, an elastic unit, an operating arm, a link unit, and a clamping unit. The base has an accommodating trough. The elastic unit has a shaft, a spring and a slide. The shaft is disposed in the accommodating trough. The spring is sleeved onto the shaft. The slide is movably disposed on the shaft. An end of the spring is abutted against an end of the accommodating trough. Another end of the spring pushes the slide. The operating arm is provided with an end having a pivotably connecting portion and another end having a pulled portion. Applying a force to the pulled portion can cause the pivotably connecting portion to pivot. The link unit has a first link and a second link pivotably connected with each other. The first link is also pivotably connected with the pivotably connecting portion of the operating arm. The second link is pivotably connected with the slide. The second link has a cam. When the first link is moved by the operating arm, the first link drives the second link to swing relative to the slide, causing the cam to move away from the shaft or move toward the shaft to press the shaft by rolling. The clamping unit has a fixed clamp body and a movable clamp body. The fixed clamp body is disposed on the base. The movable clamp body is pivotably connected with the base. The movable clamp body is also pivotably connected with the pivotably connecting portion of the operating arm.

As a result, applying a force to the operating arm of the present invention can drive the movable clamp body to open or close relative to the fixed clamp body. When the movable clamp body and the fixed clamp body are coupled with each other to clamp the tube of the bicycle frame, the operating arm is limited by the link unit and the elastic unit and thereby difficult to swing up. For clamping bicycle frame tubes with different radius, the effects of stable clamping by equal force and convenient operation are further provided.

DETAILED DESCRIPTION OF THE INVENTION

Figure 1:
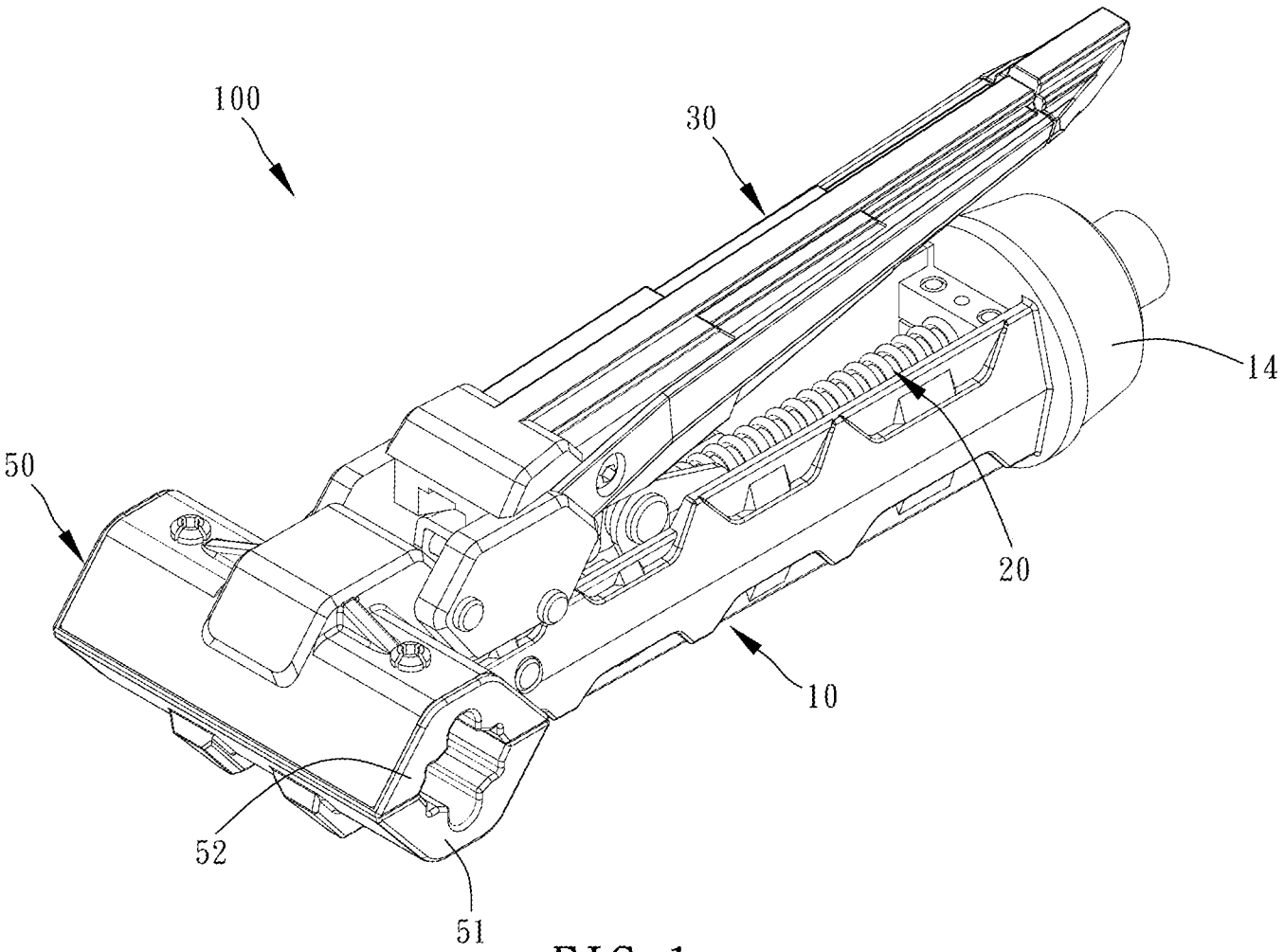
FIG. 1 is an assembled perspective view of a preferred embodiment of the present invention.
Figure 2:
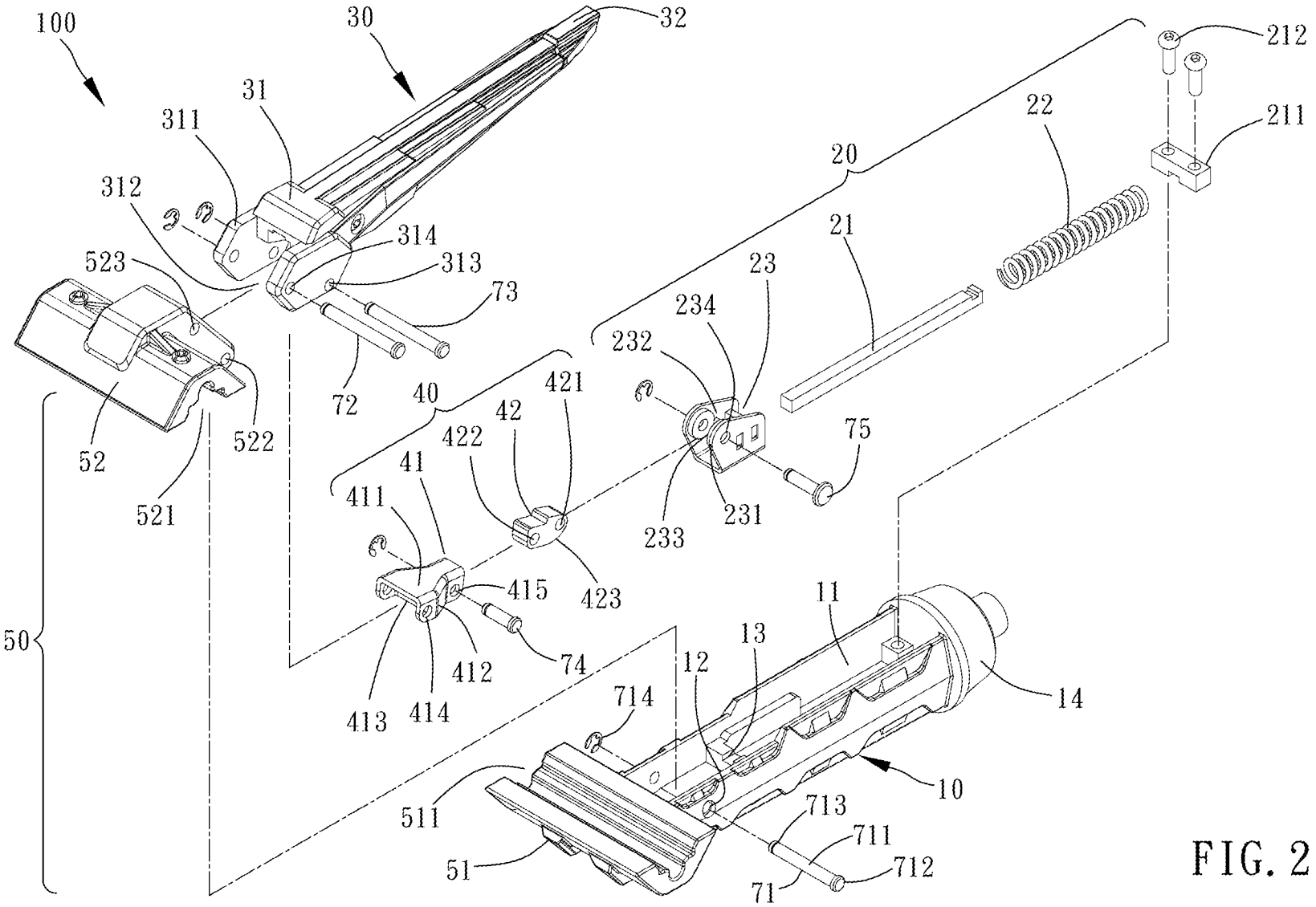
FIG. 2 is an exploded perspective view of the preferred embodiment of the present invention.

For the detailed description of the technical features of the present invention, a preferred embodiment is given herein below and illustrated by the accompanying drawings.

Referring to FIG. 1 to FIG. 8, a clamp 100 of a bicycle workstand provided by a preferred embodiment of the present invention includes a base 10, an elastic unit 20, an operating arm 30, a link unit 40, and a clamping unit 50.

The base 10 has an accommodating trough 11 which has an upward opening. Each of two walls of the accommodating trough 11 is provided with a first hole 12. The accommodating trough 11 is provided therein with a protruding stopping portion 13. An end of the base 10 is connected with the clamping unit 50 and another end of the base 10 is connected with a connecting rod 14. The structure and function of the connecting rod 14 will be described below.

The elastic unit 20 has a shaft 21, a spring 22 and a slide 23. The spring 22 is sleeved onto the shaft 21. The slide 23 is movably disposed on the shaft 21. An end of the spring 22 is abutted against an end of the accommodating trough 11. Another end of the spring 22 pushes the slide 23. The slide 23 is a base having a bottom plate 231, two side walls 232 located on two sides of the bottom plate 231, and a recessed space 233 opened upwardly. Each of the two side walls 232 is provided with a first hole 234. The shaft 21 is a rectangular shaft, an end of which is accompanied with a pressing block 211 and two bolts 212 inserted therethrough and thereby fastened to an end of the accommodating trough 11. Another end of the shaft 21 is inserted through the recessed space 233 of the slide 23 and disposed on the protruding stopping portion 13 located in the accommodating trough 11. The slide 23 is movable along the shaft 21 and keeps pushed by the spring 22 toward the protruding stopping portion 13 and stopped by the protruding stopping portion 13.

The operating arm 30 is provided at an end thereof with a pivotably connecting portion 31 and at another end thereof with a pulled portion 32. The pivotably connecting portion 31 has two lateral sheets 311 and an activity space 312 located between the two lateral sheets 311. Each of the two lateral sheets 311 is provided with a first hole 313 and a second hole 314.

The link unit 40 has a first link 41 and a second link 42. The first link 41 has a top plate 411, two side walls 412 located on two sides of the top plate 411, and a recessed space 413 located between the two side walls 412. Each of the two side walls 412 is provided with a first hole 414 and a second hole 415. An end of the first link 41 is disposed in the activity space 312 of the operating arm 30. The first link 41 is pivotably connected to the pivotably connecting portion 31 of the operating arm 30 by a third pivot 73 inserted through the first holes 414 of the first link 41 and the first holes 313 of the pivotably connecting portion 31. The second link 42 is an elongated block provided at two ends thereof with a first hole 421 and a second hole 422. An end of the second link 42 is inserted into the recessed space 413 of the first link 41. The second link 42 is pivotably connected with the first link 41 by a fourth pivot 74 inserted through the second hole 422 of the second link 42 and the second holes 415 of the first link 41. Another end of the second link 42 is accommodated in the recessed space 233 of the slide 23. The second link 42 is pivotably connected with the slide 23 by a fifth pivot 75 inserted through the first hole 421 of the second link 42 and the first holes 234 of the slide 23. The second link 42 has a cam 423 located between the first hole 421 and the second hole 422. The cam 423 is provided on the bottom surface of the block and convex-arc-shaped.

The clamping unit 50 has a fixed clamp body 51 and a movable clamp body 52. Each of the fixed clamp body 51 and the movable clamp body 52 has a clamp portion 511 and 521. The fixed clamp body 51 is disposed on the base 10 and located adjacent to the first holes 12. The movable clamp body 52 is provided with a first hole 522 and a second hole 523. The movable clamp body 52 is pivotably connected with the base 10 by a first pivot 71 inserted through the first hole 522 of the movable clamp body 52 and the first holes 12 of the base 10. The movable clamp body 52 is partially disposed in the activity space 312 of the operating arm 30. The movable clamp body 52 is pivotably connected to the pivotably connecting portion 31 by a second pivot 72 inserted through the second hole 523 of the movable clamp body 52 and the second holes 314 of the pivotably connecting portion 31.

The aforesaid first pivot 71, second pivot 72, third pivot 73, fourth pivot 74 and fifth pivot 75 are identical in structure. As the representation, the first pivot 71 is described below and provided with detailed numerals in the figures. In this embodiment, the first pivot 71 has a rod 711 and a C-shaped retaining ring 714. The rod 711 has a head end having an expanded portion 712 and a tail end having a groove 713. When the rod 711 is inserted through one of the first holes 12 with the expanded portion 712 stopped against the periphery of the first hole 12, inserted through the first hole 522 of the movable clamp body 52 and then inserted through the other first hole 12, the C-shaped retaining ring 714 is disposed in the groove 713 to be stopped against the periphery of said the other first hole 12.

The above description illustrates the structure of the present invention. The following description will illustrate the operating condition of the present invention.

Figure 4:
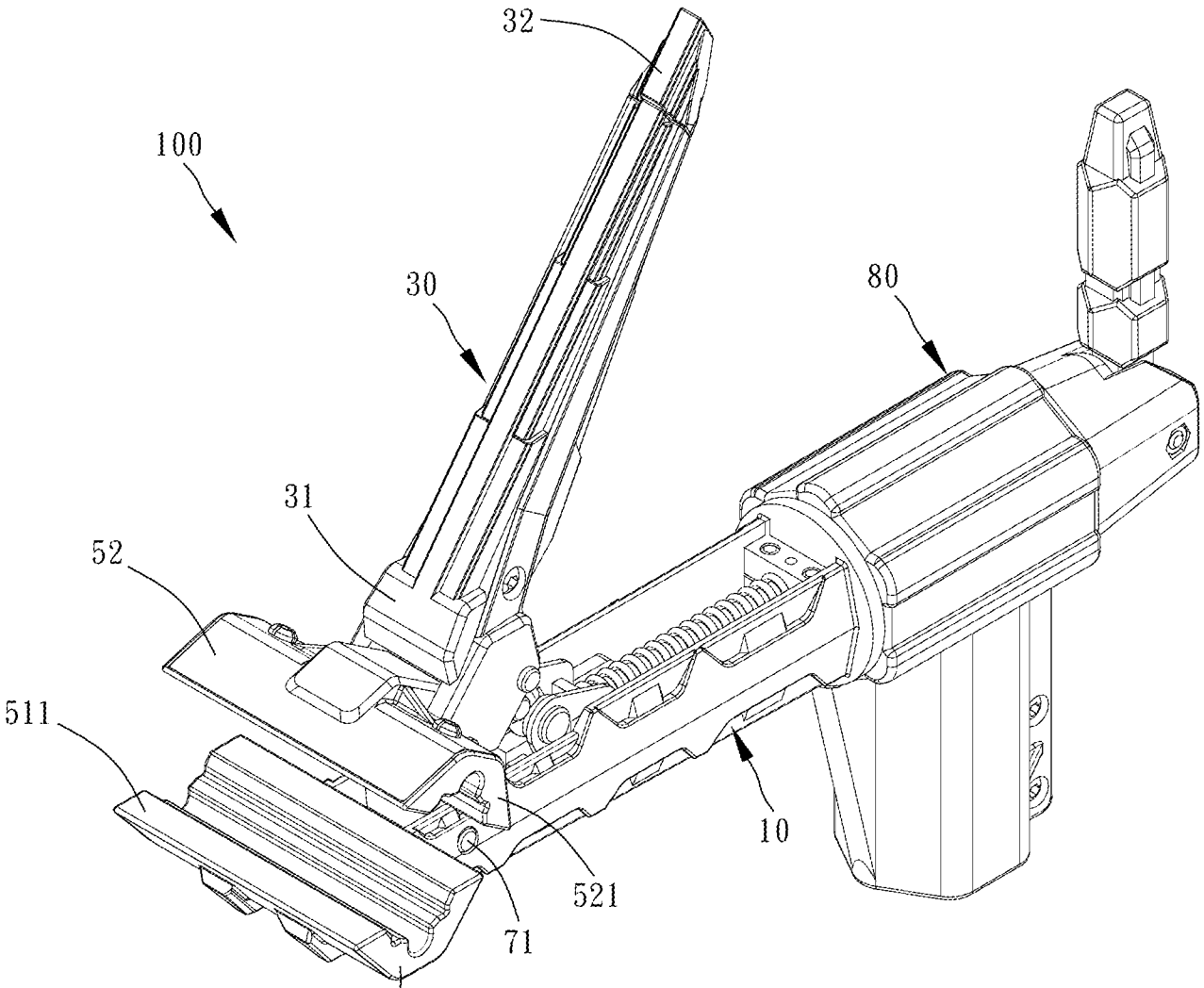
FIG. 4 is a schematic perspective view showing the appearance of the preferred embodiment of the present invention when its movable clamp body and fixed clamp body are in an open condition.
Figure 5:
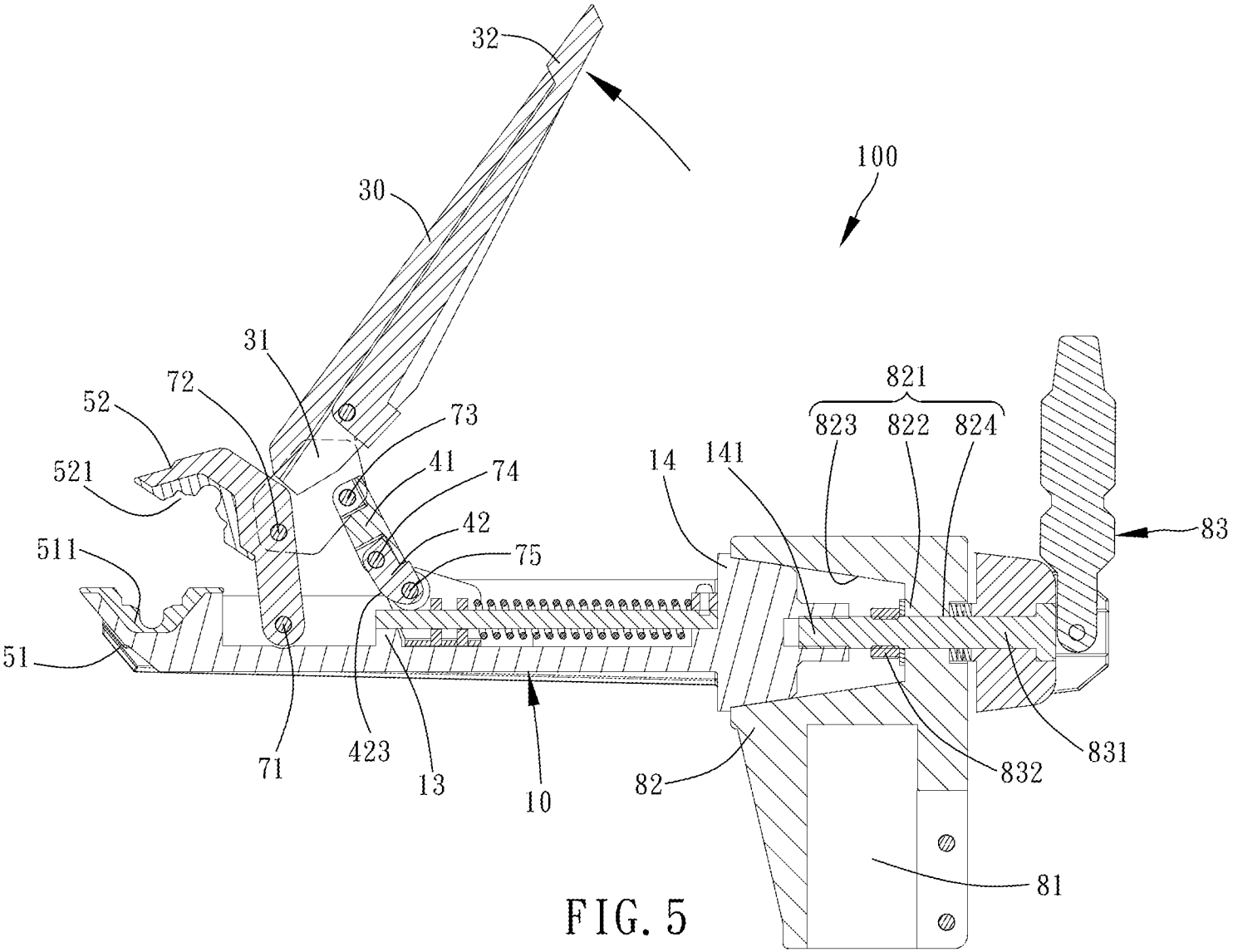
FIG. 5 is a schematic sectional view of FIG. 4.

Through the above-described structure, referring to FIG. 4 and FIG. 5, during the operation of the clamp 100 of the bicycle workstand of the present invention, firstly, the operating arm 30 is applied with a force which pulls up the pulled portion 32 to the highest point, that is defined as a first position of the present invention, causing the pivotably connecting portion 31 to swing. When the pivotably connecting portion 31 swings, the first link 41 and the second link 42 are pulled up to move away from the base 10. At the same time, the movable clamp body 52 pivotably connected with the pivotably connecting portion 31 by the second pivot 72 is also driven to pivot clockwise about the first pivot 71 to open up. Accordingly, the clamp portion 521 of the movable clamp body 52 and the clamp portion 511 of the fixed clamp body 51 are in the open condition.

Figure 6:
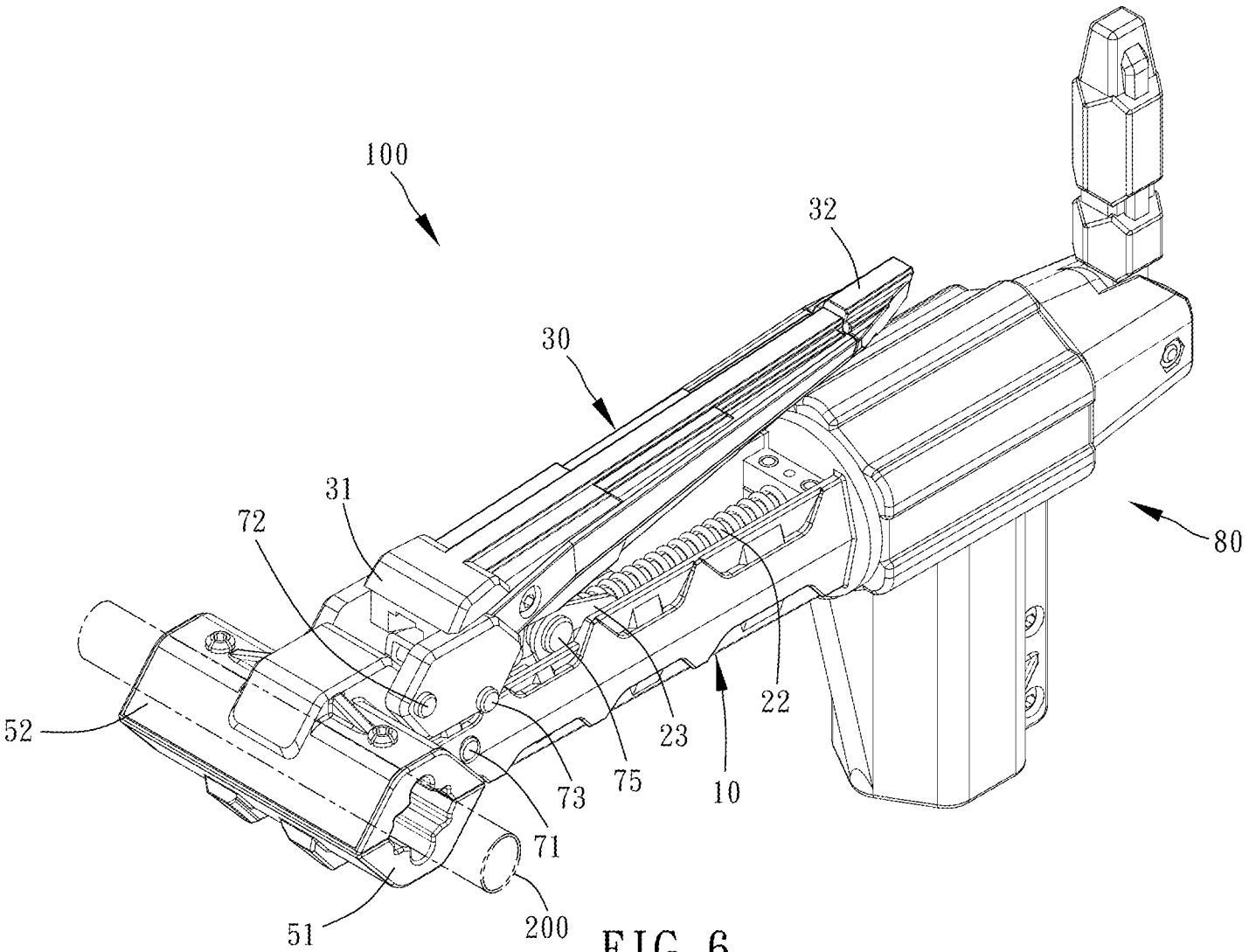
FIG. 6 is a schematic perspective view showing the appearance of the preferred embodiment of the present invention when its movable clamp body and fixed clamp body are in a close condition.
Figure 7:
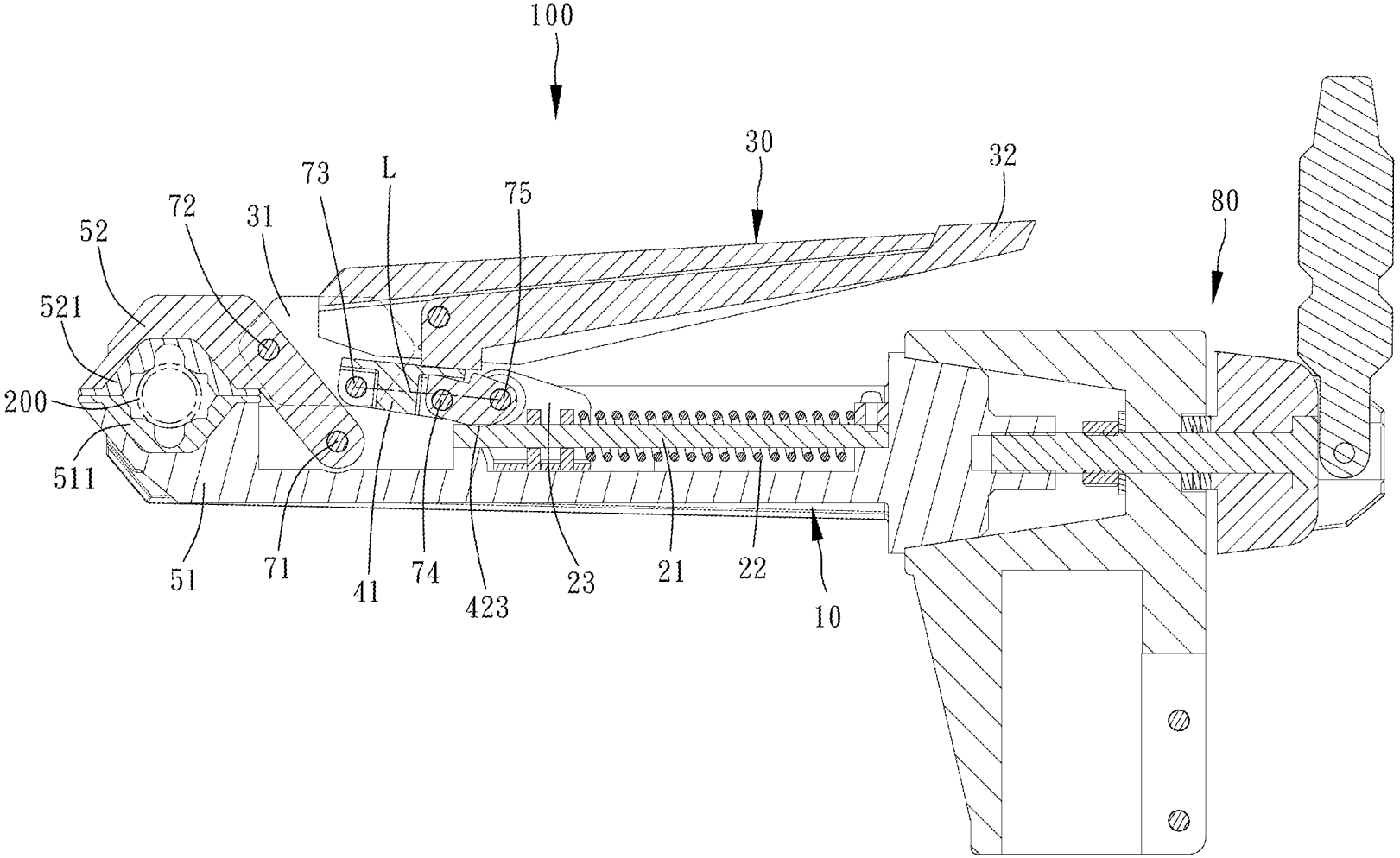
FIG. 7 is a schematic sectional view of FIG. 6.

Then, referring to FIG. 6 and FIG. 7, when the clamping action is going to be performed, a tube 200 of a bicycle frame is put into the clamp portion 511 of the fixed clamp body 51, and the pulled portion 32 of the operating arm 30 is applied with a force clockwise to be pressed down to the lowest point, that is defined as a second position of the present invention. When the operating arm 30 is moved from the first position to the second position, the pivotably connecting portion 31 swings to drive the clamp portion 521 of the movable clamp body 52 to pivot counterclockwise about the first pivot 71. Accordingly, the clamp portion 521 of the movable clamp body 52 and the clamp portion 511 of the fixed clamp body 51 are coupled with each other to clamp the tube 200 of the bicycle frame. The connecting line connecting the third pivot 73 and the fifth pivot 75 is defined as an imaginary straight line indicated by the symbol L in the figure. When the pivotably connecting portion 31 pivots, the first link 41 and the second link 42 are also driven to pivot counterclockwise to move toward the base 10 and move the slide 23 away from the protruding stopping portion 13, causing the spring 22 to be pushed and compressed. Because the second link 42 is pivotably connected with the slide 23 and the slide 23 is pushed by the spring 22, the cam 423 moves toward the shaft 21 to press the shaft 21 by rolling when the first link 41 drives the second link 42 to pivot through the fourth pivot 74. At this time, the operating arm 30 should be applied with a little more force to cause the fourth pivot 74 to pass the imaginary straight line L from the upside to the downside thereof and located below the imaginary straight line L, so that the cam 423 is tightly abutted on the upside surface of the shaft 21. In this way, the elastic force applied by the spring 22 to the slide 23 causes the clamp portion 521 of the movable clamp body 52 stably located on the clamp portion 511 of the fixed clamp body 51 for clamping. Besides, because the fourth pivot 74 is located below the imaginary straight line L, the elastic force of the spring 22 pushing the slide 23 only keeps the fourth pivot 74 located at this position but not moves it upwardly, thereby providing the effect of locking the fourth pivot 74.

When going to perform the release, the user only needs to apply an upward force to the pulled portion 32 of the operating arm 30 to move it. The above-described components will move reversely, and the fourth pivot 74 will move upwardly from the downside of the imaginary straight line L to the upside of the imaginary straight line L. Because the operating arm 30 has a relatively longer lever arm, the force applied thereto can easily overcome the pushing force applied by the spring 22 to the slide 23 and the second link 42 and the friction between the shaft 21 and the cam 423 of the second link 42 pressing the shaft 21. When the operating arm 30 is moved to the highest position, the clamp portion 521 of the movable clamp body 52 is completely open relative to the clamp portion 511 of the fixed clamp body 51, and the release action is accomplished. Based on this, the clamp 100 of the bicycle workstand of the present invention can certainly provide the effect of stable clamping. Besides, the shaft 21 of the present invention is configured as a rectangular shaft for the purpose of relatively larger contact area between the cam 423 and the shaft 21 to provide relatively larger frictional resistance, so that the operating arm 30 operated by the user is prevented by buffer resistance from a sudden large action.

Figure 8:
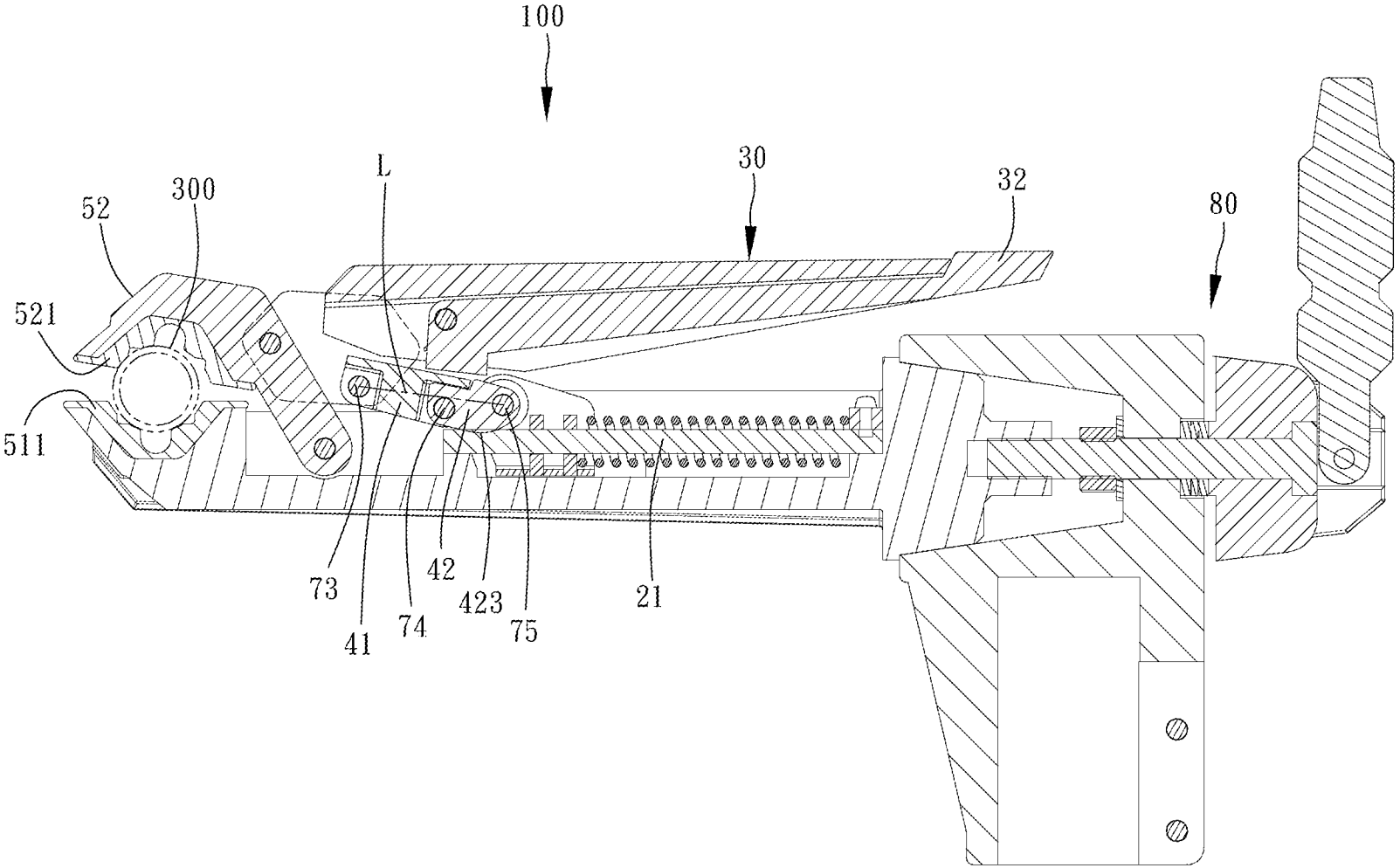
FIG. 8 is a schematic sectional view of the preferred embodiment of the present invention clamping a bicycle frame tube with different radius from that in FIG. 7.

In other usage conditions such as the condition as shown in FIG. 8 that the tube 300 of the bicycle frame has a larger radius than that of the aforesaid tube 200 of the bicycle frame, the clamp 100 of the bicycle workstand of the present invention is operated in a way that the tube 300 of the bicycle frame is put between the movable clamp body 52 and the clamp portion 511 of the fixed clamp body 51 in the open condition and then the pulled portion 32 of the operating arm 30 is pressed down clockwise to cause the movable clamp body 52 to pivot to a position where the clamp portion 521 thereof and the clamp portion 511 of the fixed clamp body 51 clamp the tube 300 of the bicycle frame and cause the first link 41 and the second link 42 to pivot counterclockwise to move toward the base 10. At this time, because the tube 300 of the bicycle frame has the relatively larger radius, the distance between the clamp portion 521 of the movable clamp body 52 and the clamp portion 511 of the fixed clamp body 51 coupled with each other is relatively larger. In the process that the pulled portion 32 of the operating arm 30 is pressed down, the slide 23 is also moved away from the protruding stopping portion 13, the fourth pivot 74 also passes the imaginary straight line L from the upside to the downside thereof and located below the imaginary straight line L, and the cam 423 of the second link 42 also presses the shaft 21 by rolling and is tightly abutted on the shaft 21. Besides, based on the acting principle of the spring, the elastic force applied to the slide 23 by the spring 22 is equal in magnitude to the elastic force applied to the slide 23 in the aforesaid case that the relatively thinner tube 200 of the bicycle frame is clamped. In other words, the force applied to the movable clamp body 52 by the spring 22 is also equal to the force in the aforesaid case that the relatively thinner tube 200 is clamped. In this way, the force of the clamping unit 50 clamping the relatively thicker tube 300 will be equal to the force of clamping the aforesaid relatively thinner tube 200, and has the effect of stable clamping.

It can be known from the above description that the movable clamp body 52 and the fixed clamp body 51 can stably clamp the tube 200 or 300 of the bicycle frame with different radius, that is operated by simple and convenient action, not only completely solving the aforesaid problem that the operation of the conventional bicycle workstand is complicated and inconvenient, but also having the effect of stable clamping by constant force. Besides, the friction provided by the cam 423 pressing the shaft 21 by rolling can provide buffer resistance to prevent the operation from a sudden large action, thereby avoiding accidental injury to the user.

Furthermore, before the clamp 100 of the bicycle workstand of the present invention is in use, it can be accompanied with a seat tube 80 to be connected with and a supporting frame 90.

Figure 3:
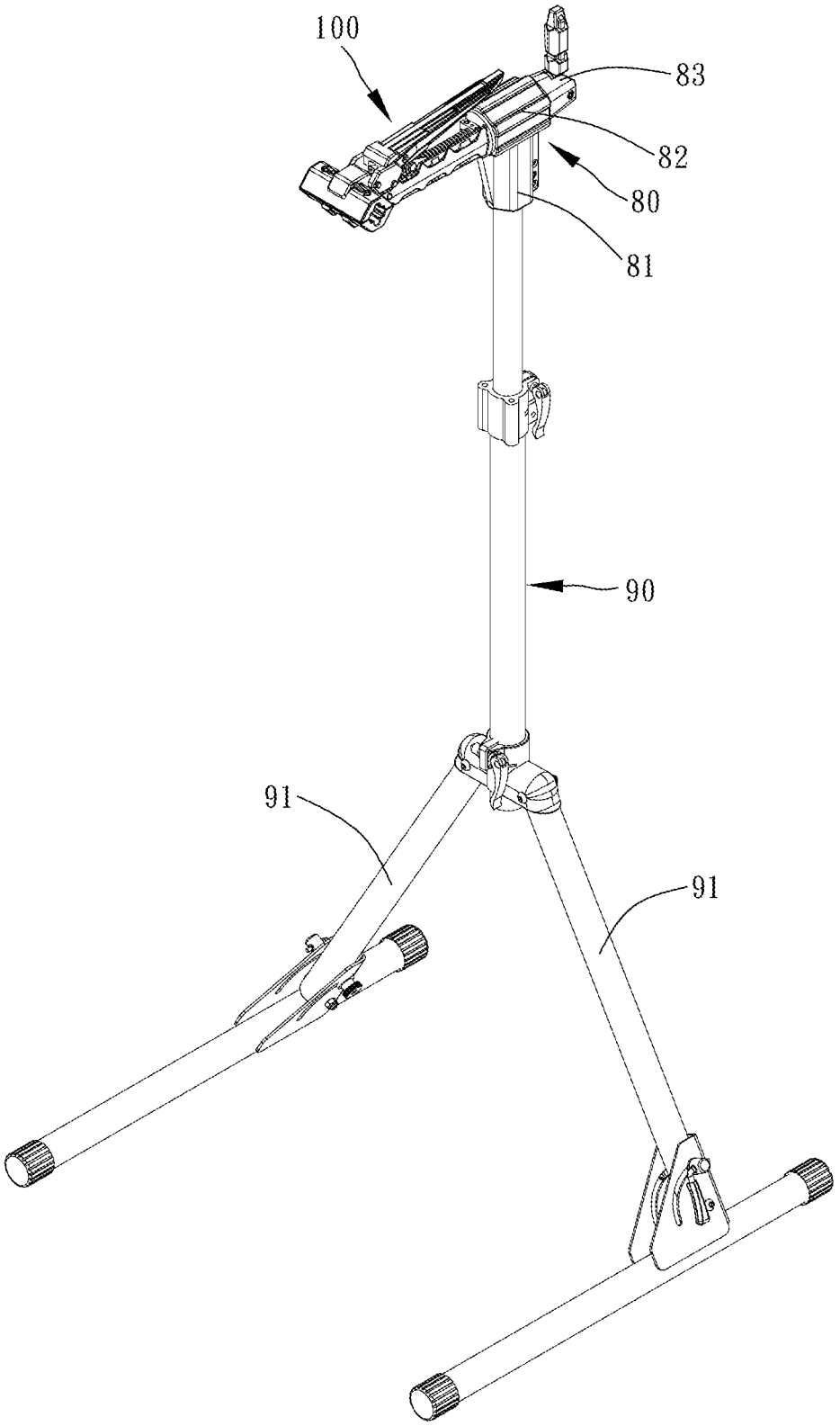
FIG. 3 is a schematic view showing the usage of the preferred embodiment of the present invention connected with a supporting frame.

As shown in FIG. 3, the seat tube 80 has a connection pipe 81 and a combination pipe 82. The connection pipe 81 is connected with the supporting frame 90. The supporting frame 90 has two foot rods 91 stably disposed on the floor. The combination pipe 82 has a combination hole 821 (referring to FIG. 5) penetrating through two ends of the combination pipe 82. The combination hole 821 has a protruding stopping portion 822 dividing the combination hole 821 into a large radius portion 823 and a small radius portion 824. A quick release unit 83 is disposed at the small radius portion 824 of the combination hole 821. The quick release unit 83 has a threaded rod 831. The threaded rod 831 is inserted through the small radius portion 824 and accompanied with a nut 832. The nut 832 is screwed onto the threaded rod 831 and stopped against the protruding stopping portion 822. The connecting rod 14 is disposed at the large radius portion 823 of the combination hole 821. The connecting rod 14 is rotatable relative to the seat tube 80. The connecting rod 14 has a threaded hole 141. The threaded rod 831 is tightly screwed into the threaded hole 141. In this way, the base 10 can be swayed relative to the seat tube 80 to change the relative angle between the bicycle workstand and the tube 200 or 300 of the bicycle frame clamped thereon for benefiting the worker in maintaining each portion and component of the bicycle. As a result, the present invention is certainly capable of adjusting the angle of the bicycle clamped on the bicycle workstand differently from the prior art, providing the user convenience in maintaining each portion and component of the bicycle.

What is claimed is:

1. A clamp of a bicycle workstand, which is adapted to be connected with a supporting frame for clamping a tube of a bicycle frame, the clamp comprising:

a base having an accommodating trough;

an elastic unit having a shaft, a spring and a slide, the shaft being disposed in the accommodating trough, the spring being sleeved onto the shaft, the slide being movably disposed on the shaft, an end of the spring being abutted against an end of the accommodating trough, another end of the spring pushing the slide;

an operating arm which is provided with an end having a pivotably connecting portion and another end having a pulled portion in a way that applying a force to the pulled portion causes the pivotably connecting portion to pivot;

a link unit having a first link and a second link pivotably connected with each other, the first link being also pivotably connected with the pivotably connecting portion of the operating arm, the second link being pivotably connected with the slide, the second link having a cam, the first link driving the second link to swing relative to the slide when the first link is moved by the operating arm, causing the cam to move away from the shaft or move toward the shaft to press the shaft by rolling;

a clamping unit having a fixed clamp body and a movable clamp body, the fixed clamp body being disposed on the base, the movable clamp body being pivotably connected with the base, the movable clamp body being also pivotably connected with the pivotably connecting portion of the operating arm;

wherein the clamp further includes a seat tube; the seat tube has a connection pipe and a combination pipe; the connection pipe is connected with the supporting frame; the combination pipe has a combination hole penetrating through two ends of the combination pipe; two opposite ends of the base are connected with the fixed clamp body and a connecting rod respectively; the connecting rod is disposed at an end of the combination hole and rotatable relative to the seat tube; a quick release unit is disposed at another end of the combination hole; the connecting rod is pivotably connected with the quick release unit a relative angle between the base and the seat tube is fixed by the quick release unit.

2. The clamp as claimed in claim 1, wherein each of two walls of the accommodating trough is provided at an end thereof close to the fixed clamp body with a first hole; the movable clamp body is provided with a first hole; the movable clamp body is pivotably connected to the accommodating trough by a first pivot inserted through the first hole of the movable clamp body and the first holes of the accommodating trough; the movable clamp body is pivotable about the first pivot.

3. The clamp as claimed in claim 2, wherein the movable clamp body is provided with a second hole; the pivotably connecting portion of the operating arm has two lateral sheets and an activity space located between the two lateral sheets; each of the two lateral sheets is provided with a first hole and a second hole; the movable clamp body is partially disposed in the activity space; the movable clamp body is pivotably connected to the pivotably connecting portion by a second pivot inserted through the second hole of the movable clamp body and the second holes of the pivotably connecting portion; the operating arm moves the movable clamp body through the second pivot.

4. The clamp as claimed in claim 3, wherein the first link of the link unit has a top plate, two side walls located on two sides of the top plate, and a recessed space; each of the two side walls is provided with a first hole and a second hole; an end of the first link is disposed in the activity space of the operating arm; the first link is pivotably connected to the pivotably connecting portion of the operating arm by a third pivot inserted through the first holes of the first link and the first holes of the pivotably connecting portion; the operating arm moves the first link through the third pivot.

5. The clamp as claimed in claim 4, wherein the second link is an elongated block provided at two ends thereof with a first hole and a second hole; a said end of the second link is disposed in the recessed space of the first link; the second link is pivotably connected with the first link by a fourth pivot inserted through the second hole of the second link and the second holes of the first link; the first link moves the second link through the fourth pivot.

6. The clamp as claimed in claim 5, wherein the slide of the elastic unit has a bottom plate, two side walls located on two sides of the bottom plate, and a recessed space opened upwardly; each of the two side walls of the slide is provided with a first hole; another said end of the second link is accommodated in the recessed space of the slide; the second link is pivotably connected with the slide by a fifth pivot inserted through the first hole of the second link and the first holes of the slide.

7. The clamp as claimed in claim 6, wherein the cam of the second link is located between the first hole and the second hole of the second link; the cam is provided on a bottom surface of the block and convex-arc-shaped; the shaft of the elastic unit is a rectangular shaft; an end of the shaft is accompanied with a pressing block and two bolts inserted therethrough to an end of the accommodating trough; another end of the shaft is inserted through the recessed space of the slide and disposed on a protruding stopping portion located in the accommodating trough; define that the operating arm is pulled up to a highest point as a first position and that the operating arm is pressed down to a lowest point as a second position; define a connecting line connecting the third pivot and the fifth pivot as an imaginary straight line; in the process that the operating arm moves from the first position to the second position, the fourth pivot passes the imaginary straight line from upside to downside thereof and located below the imaginary straight line.

8. The clamp as claimed in claim 1, wherein the fixed clamp body has a clamp portion; the movable clamp body also has a clamp portion; the clamp portions of the fixed clamp body and the movable clamp body are both concave-arc-shaped.

9. The clamp as claimed in claim 1, wherein the combination hole has a protruding stopping portion dividing the combination hole into a large radius portion and a small radius portion; the quick release unit has a threaded rod; the threaded rod is inserted through the small radius portion and accompanied with a nut; the nut is screwed onto the threaded rod and stopped against the protruding stopping portion; the connecting rod has a threaded hole; the connecting rod is disposed at the large radius portion; the threaded rod is tightly screwed into the threaded hole.

10. The clamp as claimed in claim 1, wherein the supporting frame has two foot rods stably disposed on a floor.

* * * * *